US007824418B2

(12) United States Patent
Liu

(10) Patent No.: US 7,824,418 B2
(45) Date of Patent: Nov. 2, 2010

(54) ELECTRICAL DEPILATOR

(76) Inventor: Laisheng Liu, 404 Room, D. Bldg., No. 2 Xinhua Road, Siming District, Xiamen, 361002 (CN)

( * ) Notice: Subject to any disclaimer, the term of this patent is extended or adjusted under 35 U.S.C. 154(b) by 22 days.

(21) Appl. No.: 10/573,099

(22) PCT Filed: Feb. 6, 2005

(86) PCT No.: PCT/CN2005/000178

§ 371 (c)(1),
(2), (4) Date: Mar. 22, 2006

(87) PCT Pub. No.: WO2006/081709

PCT Pub. Date: Aug. 10, 2006

(65) Prior Publication Data

US 2008/0195118 A1 Aug. 14, 2008

(51) Int. Cl.
*A61B 17/50* (2006.01)

(52) U.S. Cl. ..... 606/133

(58) Field of Classification Search ..... 24/94; 29/415, 432.2, 798; 30/28, 43.92, 43.4–43.7; 165/173; 222/94; 269/45, 217; 280/743.1; 606/9, 36, 43, 133, 131
See application file for complete search history.

(56) References Cited

U.S. PATENT DOCUMENTS

| | | | | |
|---|---|---|---|---|
| 853,096 | A | 5/1907 | Lewis | |
| 1,071,978 | A | 9/1913 | White | |
| 2,417,530 | A | 3/1947 | Weiser | |
| 2,888,927 | A | 6/1959 | Fozard | |
| 2,894,512 | A | 7/1959 | Tapper | |
| 3,054,405 | A | 9/1962 | Tapper | |
| 3,088,470 | A | 5/1963 | Hall | |
| 3,501,836 | A * | 3/1970 | Moret et al. | 30/43.92 |
| 3,673,671 | A * | 7/1972 | Petersen | 29/432.2 |
| 4,174,713 | A | 11/1979 | Mehl | |
| 4,274,413 | A | 6/1981 | Hahn et al. | |
| 4,935,024 | A | 6/1990 | Dolev | |
| 5,011,485 | A | 4/1991 | Daar et al. | |
| 5,057,115 | A | 10/1991 | Dolev | |

(Continued)

FOREIGN PATENT DOCUMENTS

EP 774912 B2 5/1997

(Continued)

*Primary Examiner*—Gary Jackson
*Assistant Examiner*—David Eastwood
(74) *Attorney, Agent, or Firm*—White & Case LLP

(57) ABSTRACT

The present invention provides an electrical depilator comprising substantially of a main body, a motor, a reduction gear set, an arcuate shaft and a set of single-pieces. The arcuate shaft is supported on a shaft seat of the main body. A first stage gear of the reduction gear set meshes with the driving wheel of the motor, and a last stage gear is fixed on the single-piece which is located at the endmost portion. Each single-piece has a clipping surface and a supporting portion. The whole set of single-pieces are arranged in a manner that the clipping surfaces are opposite to each other. A clipping gap is formed between opposite surfaces of two single-pieces. The whole set of single-pieces are coupled together by fixing members so as to rotate synchronously. The whole set of single-pieces are fitted over the arcuate shaft all together. The electrical depilator is easy in die sinking, convenient in assembling, and of low cost.

5 Claims, 12 Drawing Sheets

U.S. PATENT DOCUMENTS 5,057,116 A 10/1991 Zucker
5,084,055 A 1/1992 Demeester
5,084,056 A 1/1992 Eckel et al.
5,100,414 A * 3/1992 Dolev ..... 606/133
5,108,410 A * 4/1992 Iwasaki et al. ..... 606/133
5,163,288 A 11/1992 Doley
5,196,021 A 3/1993 Kabla
5,226,907 A 7/1993 Tankovich
5,230,303 A 7/1993 Rubino
5,234,442 A * 8/1993 Schafer et al. ..... 606/133
5,281,233 A * 1/1994 Dolev ..... 606/133
5,346,499 A 9/1994 Garenfeld et al.
5,356,415 A * 10/1994 Iwasaki et al. ..... 606/133
5,419,344 A 5/1995 DeWitt
5,425,728 A 6/1995 Tankovich
5,507,753 A * 4/1996 Iwasaki et al. ..... 606/133
5,595,568 A 1/1997 Anderson et al.
5,611,804 A * 3/1997 Heintke et al. ..... 606/133
5,630,811 A 5/1997 Miller
5,797,925 A * 8/1998 Heintke ..... 606/133
5,810,843 A * 9/1998 Iwasaki et al. ..... 606/133
5,893,854 A 4/1999 Bontoux et al.
5,976,157 A * 11/1999 Yiu ..... 606/133
6,045,559 A 4/2000 Sueyoshi et al.
6,067,714 A 5/2000 Taylor et al.
6,083,233 A 7/2000 Kreutz et al.
6,123,713 A * 9/2000 Yiu et al. ..... 606/133
6,165,182 A 12/2000 Caric et al.
6,293,953 B1 * 9/2001 Kreutz et al. ..... 606/133
6,322,569 B1 * 11/2001 Sueyoshi et al. ..... 606/133
6,436,106 B2 * 8/2002 Yiu ..... 606/133
6,689,143 B2 2/2004 Cense et al.
6,730,099 B1 5/2004 Sanchez-Martinez et al.
6,824,461 B1 * 11/2004 Dolev ..... 452/83
6,824,546 B1 11/2004 Yiu
7,147,645 B2 12/2006 Sanchez-Martinez et al.

FOREIGN PATENT DOCUMENTS

EP 760219 10/2001
FR 26867001 7/1993
FR 2699448 6/1994
JP 11-299530 11/1999
WO WO-02/052976 7/2002

* cited by examiner

ELECTRICAL DEPILATOR

BACKGROUND OF THE INVENTION

1. Field of the Invention

The present invention relates to an electrical depilator, in particularly, to an electrical depilator which is easy in die sinking, convenient in assembling, and of low cost.

2. Description of the Related Art

There are various electrical depilators with different constructions in conventional technology and there are a great many patents relating to depilators. FIG. 1 shows a type of depilator among conventional ones. The depilator comprises a main body 1', a motor 2', a reduction gear set 3', an arcuate shaft 4', a set of base pieces 5' and thin clipping pieces 6'. Each clipping piece 6' is fixed on a corresponding base piece 5', that is, the thin clipping piece 6' is supported on and driven by the base piece 5' to move correspondingly. The whole set of base pieces 5' are coupled together by shifting yokes (not shown, or by bearing housings or shaft pins) so as to rotate synchronously. The whole set of base pieces 5' and the thin clipping pieces 6' are fitted over the arcuate shaft 4' which is supported on a shaft seat of the main body 1'. A first stage gear of the reduction gear set 3' meshes with a driving wheel of the motor 2', and a last stage gear is fixed on the base piece 5' which is located at the endmost position.

When it is energized, the driving wheel of the motor 2' drives the whole set of base pieces 5' and the thin clipping pieces 6' supported on the base pieces 5' through the reduction gear set 3' to rotate around the arcuate shaft 4'. Thereby, the clipping pieces 6' on the gradually-narrowed side of the arcuate shaft 4' are caused to perform a clipping action by the way of being pressed by the base pieces 5', and those on the gradually-widened side of the arcuate shaft 4' perform a loosening action. Thus, hairs are depilated rapidly on the gradually-narrowed side of the arcuate shaft 4' by the clipping pieces 6', while the depilated hairs are thrown into the hair-collecting box on the gradually-widened side of the arcuate shaft 4'. Therefore, such depilator can depilate hairs rapidly.

However, it can be readily appreciated that the above-mentioned depilator has the following disadvantages after a close study of its structure.

The depilator comprises a plurality of base pieces 5' performing pressure transfer and motion functions and thin clipping pieces 6' supported by the pieces 5' and performing a hair clipping function. In addition, the plurality of base pieces 5' and the clipping pieces 6' are arranged alternately in the following manner: one base piece 5'→two thin clipping pieces 6'→one base piece 5' . . . and so on. Thus, there are too many members, which need die sinking not only for forming base piece 5' but also for forming thin clipping pieces 6'. Therefore, it is difficult in die sinking. Furthermore, the cost of manufacture is high because the structure of the depilator is complicated and the thin clipping pieces 6' are generally made of metals. Moreover, the assembling procedure is very troublesome because of the alternate arrangement in the form of one base piece 5'→two thin clipping pieces 6'→one base piece 5' . . . and so on.

SUMMARY OF INVENTION

In view of the above disadvantages in the conventional art, it is an object of the present invention to provide an electrical depilator which is easy in die sinking, convenient in assembling, and of low cost.

In order to achieve one or more aspects of the above object, the present invention provides the following technical schemes:

An electrical depilator, comprising substantially a main body, a motor, a reduction gear set, an arcuate shaft and a set of single-pieces. The arcuate shaft is supported on a shaft seat of the main body. A first stage gear of the reduction gear set meshes with a driving wheel of the motor, and a last stage gear is fixed on the single-piece which is located at the endmost position. Each single-piece has a clipping surface and a supporting portion. The whole set of single-pieces are arranged with the clipping surfaces opposite to each other. A clipping gap is formed between the opposite surfaces of two single-pieces. The whole set of single-pieces are coupled together by fixing members to rotate synchronously. The whole set of single-pieces are fitted over the arcuate shaft all together.

The fixing members are shifting yokes which are formed on both sides of each single-piece. One shifting yoke on a single-piece is inserted into and locked with another shifting yoke of an adjacent single-piece, thus the whole set of single-pieces are coupled together and rotated synchronously.

The fixing members are fork bodies which are provided with shaft holes at centers thereof corresponding to the position of the arcuate shaft. Each single-piece is provided at both sides with fork shaped slots. Both sides of each fork body are inserted into and locked with two fork shaped slots of two adjacent single-pieces, thus the whole set of single-pieces are coupled together and rotated synchronously.

A thin piece is fixed on each fork body. The thin pieces and the fork bodies, together with the whole set of single-pieces, are fitted over the arcuate shaft. The thin piece is provided between two opposite clipping surfaces of two single-pieces, and two clipping gaps are formed between both sides of each thin piece and clipping surfaces of two single-pieces, respectively.

The fixing members are bearing housings. The whole set of single-pieces are coupled together by the bearing housings to be rotated synchronously.

The fixing members are shaft pins. The whole set of single-pieces are coupled together by the shaft pins to be rotated synchronously.

With the above structure, when energized, the driving wheel of the motor drives the whole set of singe-pieces through the reduction gear set to rotate around the arcuate shaft. Thereby, the single-pieces on the gradually-narrowed side of the arcuate shaft are caused to perform a clipping action, and those on the gradually-widened side of the arcuate shaft perform a loosening action. Thus, hairs are depilated quickly on the gradually-narrowed side of the arcuate shaft directly by use of the clipping surfaces of the singe-pieces, so as to depilate hairs quickly.

The electrical depilator according to the present invention has the following advantages over the prior arts. The depilator only has a plurality of single-pieces. That is, the two types of pieces in the conventional art, i.e. the base pieces performing pressure transfer and motion functions and the thin clipping pieces supported by the pieces and performing a hair clipping function, are simplified as one type of single-pieces. As a result, the thin clipping pieces are eliminated. Thus, the number of members is reduced, which facilitates the die sinking because only the die for forming single-pieces is needed. In addition, the structure is greatly simplified and only the single-pieces are required to be assembled in assembling. Therefore, the assembling procedure is easy and the cost is reduced.

DETAILED DESCRIPTION OF THE PREFERRED EMBODIMENTS

Embodiments of the present invention will be described in detail with reference to attached drawings.

Figure 1:
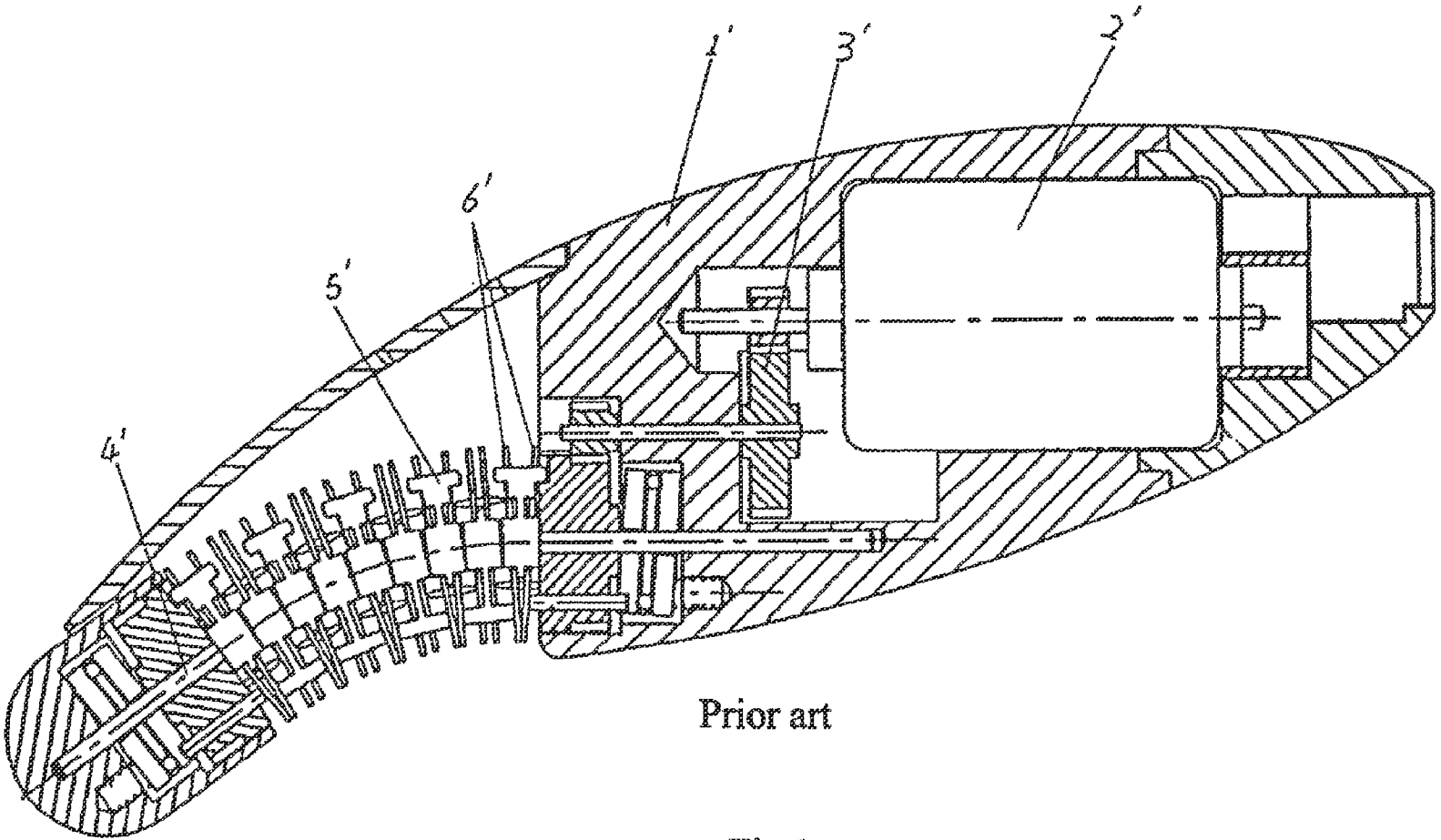
Prior art Fig.1
FIG. 1 is a schematic view showing the structure of a conventional electrical depilator.
Figure 2:
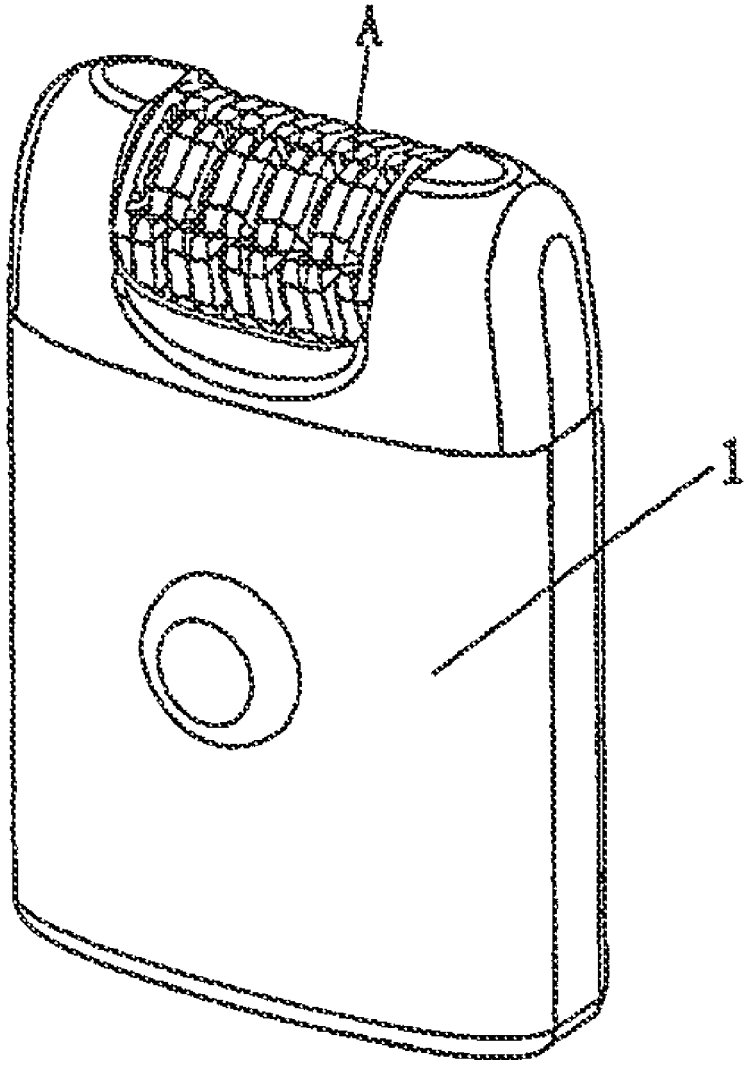
FIG. 2 is a view showing an appearance of the depilator according to one embodiment of the present invention.
Figure 3:
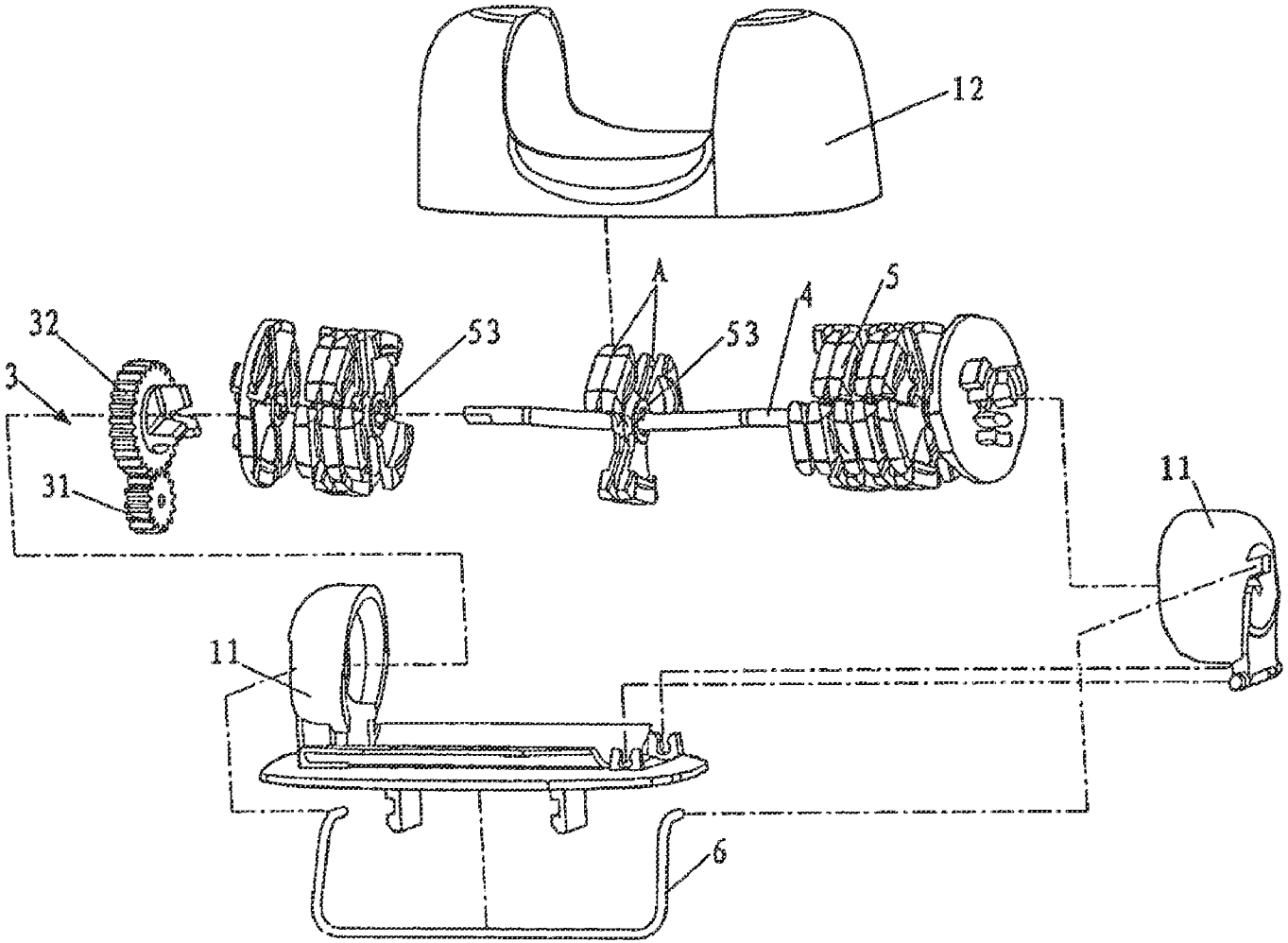
FIG. 3 is a partial exploded perspective view of the depilator according to one embodiment of the present invention.
Figure 4:
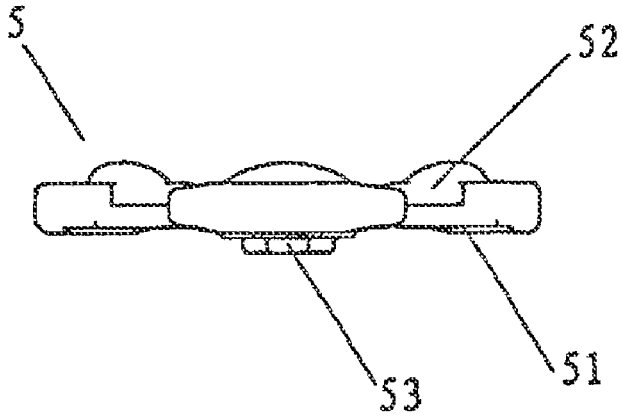
FIG. 4 is a side view of a single-piece according to one embodiment of the present invention.
Figure 5:
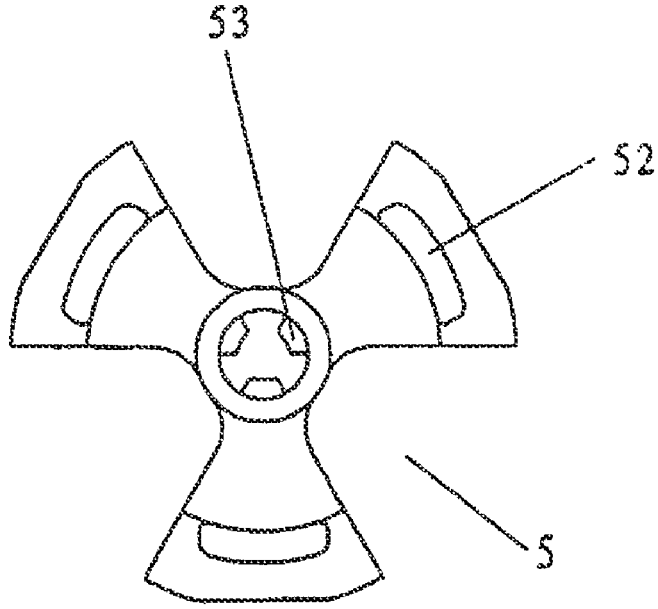
FIG. 5 is a top view of a single-piece according to one embodiment of the present invention.
Figure 6:
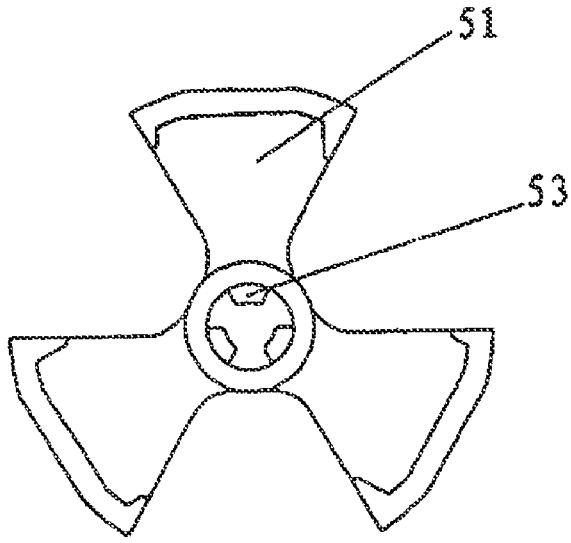
FIG. 6 is a bottom view of a single-piece according to one embodiment of the present invention.
Figure 7:
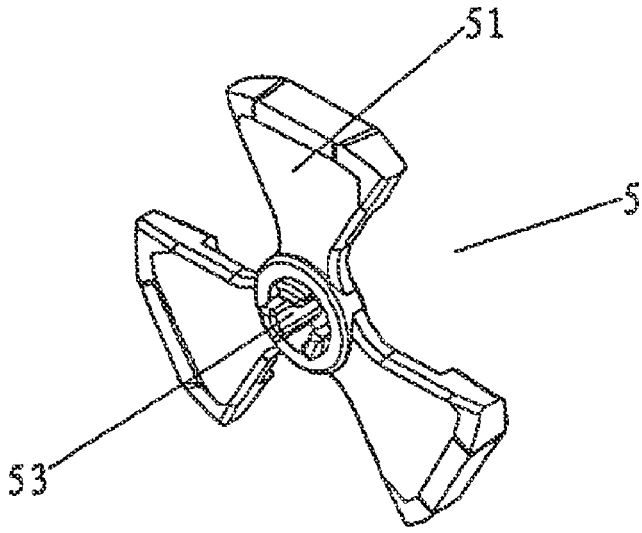
FIG. 7 is a perspective view of a single-piece according to one embodiment of the present invention.
Figure 8:
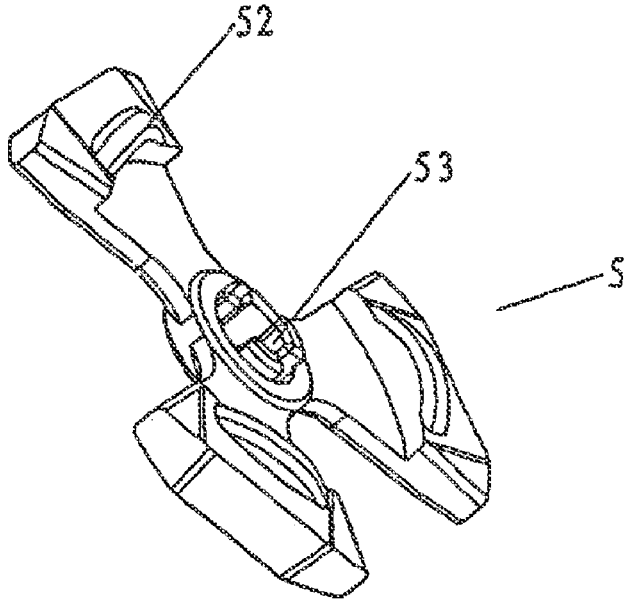
FIG. 8 is another perspective view of a single-piece according to one embodiment of the present invention.

As shown in FIG. 2 in conjunction with FIG. 3, an electrical depilator according to one preferred embodiment of the present invention comprises a main body 1, a motor (not shown), a reduction gear set 3, an arcuate shaft 4 and a set of single-pieces 5.

The arcuate shaft 4 is supported on a shaft seat 11 of the main body 1.

A first stage gear 31 of the reduction gear set 3 meshes with the driving wheel (not shown) of the motor, and a last stage gear 32 is fixed on the single-piece 5 which is located at the endmost position.

Figure 9:
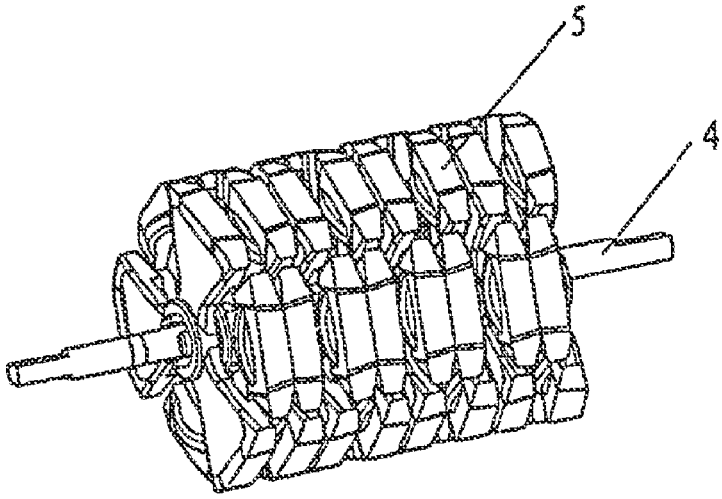
FIG. 9 is a perspective view of the whole set of single-pieces assembled on an arcuate shaft according to one embodiment of the present invention.
Figure 11:
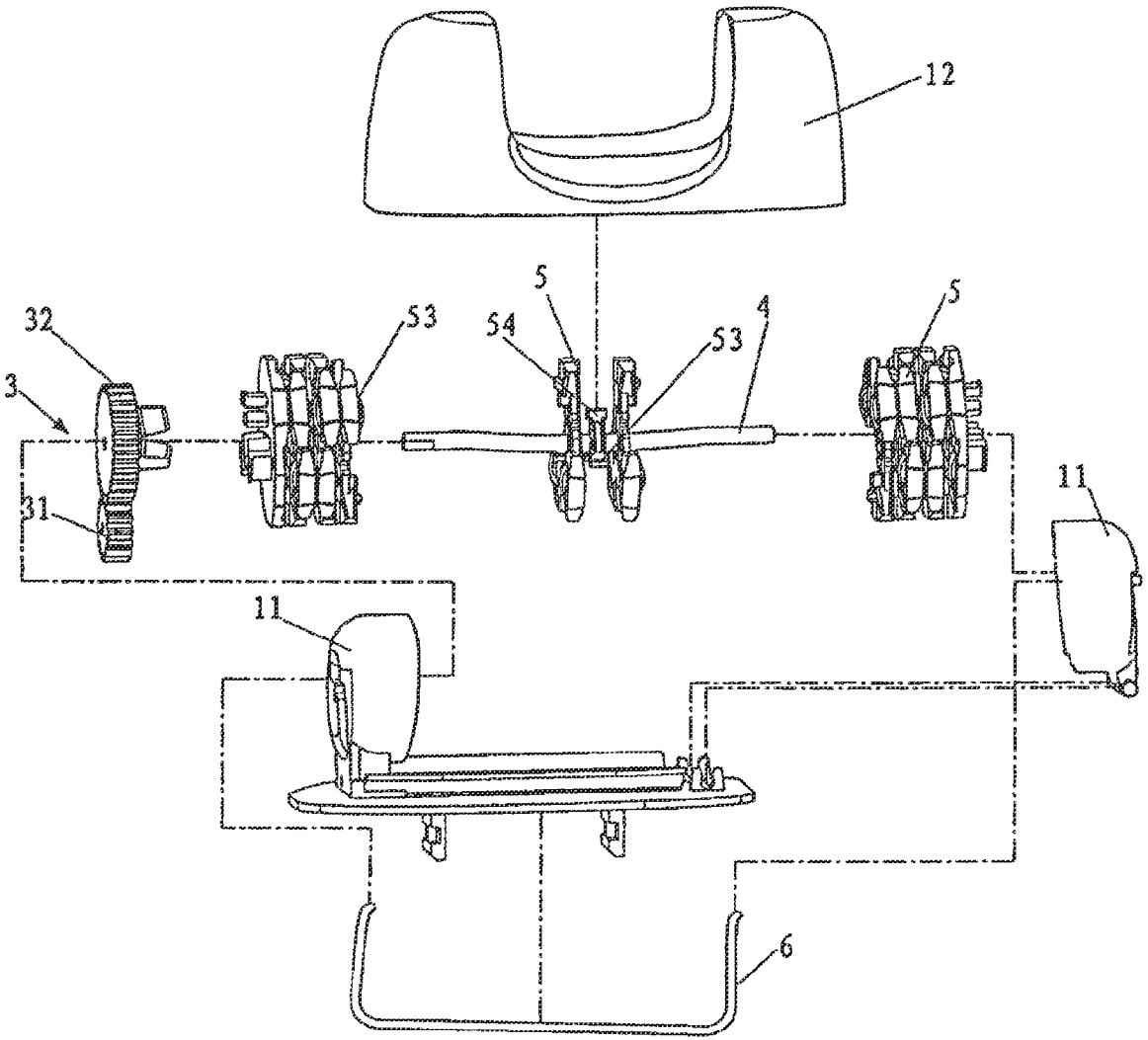
FIG. 11 is a partially exploded perspective view according to another embodiment of the present invention.
Figure 12:
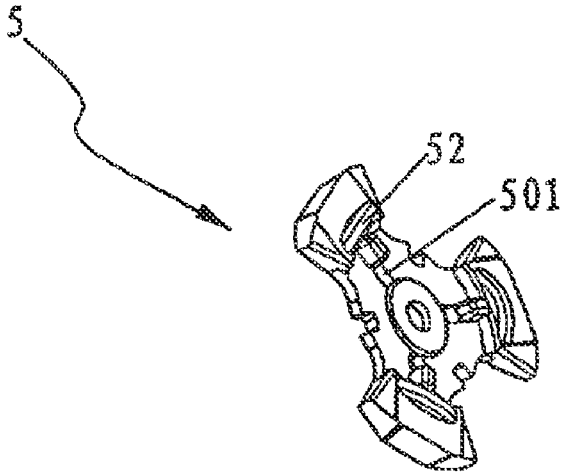
FIG. 12 is a perspective view of a single-piece according to another embodiment of the present invention.
Figure 13:
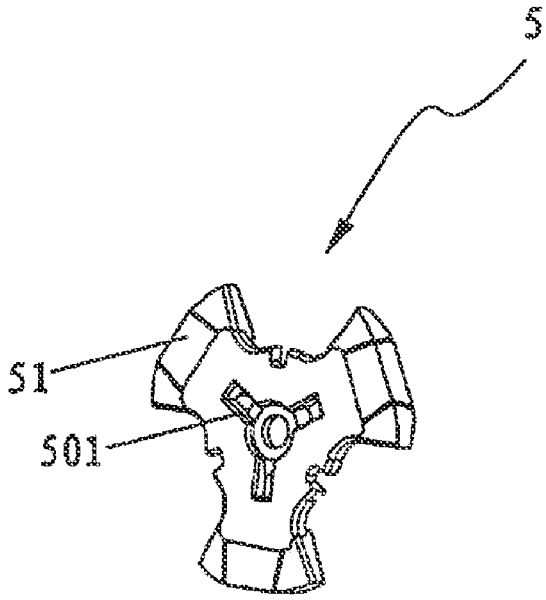
FIG. 13 is another perspective view of a single-piece according to another embodiment of the present invention.

Each single-piece 5 has a clipping surface 51 and a supporting portion 52, as shown in FIGS. 4-8. The whole set of single-pieces 5 are arranged in such a manner that the clipping surfaces 51 are opposite to each other. A clipping gap A is formed between the opposite surfaces 51 of two single-pieces 5, as shown in FIGS. 2 and 3. The whole set of single-pieces 5 are coupled together by fixing members so as to rotate synchronously. The fixing members can have a variety of specific structures. As shown in FIGS. 4-8 of this embodiment, the fixing members are shifting yokes 53 which are formed on both sides of each single-piece 5. One shifting yoke 53 on each single-piece 5 is inserted into and locked with another shifting yoke 53 on the adjacent single-piece 5, thus the whole set of single-pieces 5 are coupled together and rotated synchronously. In another embodiment, the fixing members can also be fork bodies 54 shown in FIG. 14 which have three fork feet 542 respectively and are provided with shaft holes 541 at centers thereof corresponding to the inserting position of the arcuate shaft 4. As shown in conjunction with FIGS. 12 and 13, each single-piece 5 is provided at both sides thereof with fork shaped slots 501. Both sides of each fork body (that is, the three fork feet 542) are inserted into and locked with two fork shaped slots 501 of two adjacent single-pieces 5, thus the whole set of single-pieces 5 are coupled together and rotated synchronously. The fixing members can also be bearing housings which are not shown in drawings, by which the whole set of single-pieces 5 are coupled together and rotated synchronously. The fixing members can also be shaft pins which are not shown in drawings, by which the whole set of single-pieces 5 are coupled together and rotated synchronously. Referring to FIGS. 9 and 11, the whole set of single-pieces 5 are fitted over the arcuate shaft 4 all together.

Figure 10:
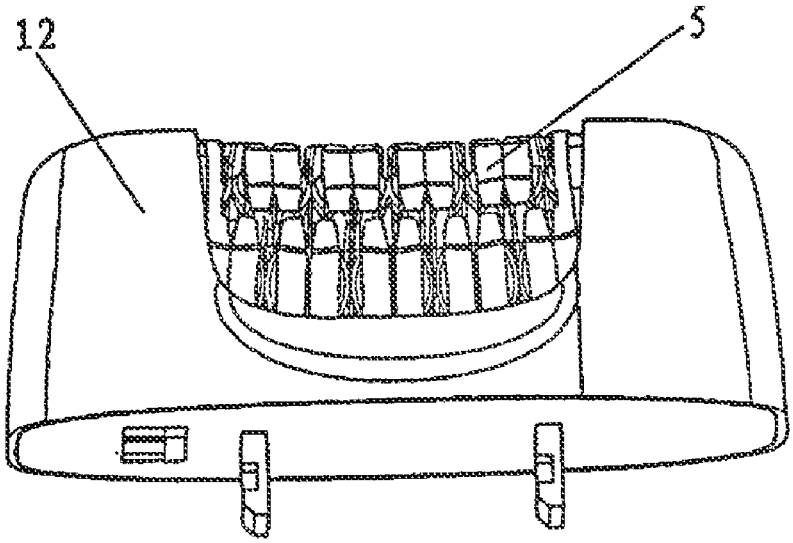
FIG. 10 is a view partially showing the parts in FIG. 3 being assembled.

To facilitate the assembling of the single-pieces 5 in the set, in the embodiment, firstly the whole set of single-pieces 5 are mounted on the shaft seat 11 by the arcuate shaft 4 and are fixed by a spring 6. Then the arcuate shaft 4, the reduction gear set 3 and the shaft seat 11 are covered by a shell 12, only the whole set of single-pieces 5 are exposed for depilating. Therefore, the depilator has a good appearance, as shown in FIG. 10.

With the above structure according to the present embodiment, when energized, the driving wheel of the motor drives the whole set of singe-pieces 5 through the reduction gear set 3 to rotate around the arcuate shaft 4. Thereby, the singe-pieces 5 on the gradually-narrowed side of the arcuate shaft are caused to perform a clipping action, and those on the gradually-widened side of the arcuate shaft perform a loosening action. Thus, hairs are depilated on the gradually-narrowed side of the arcuate shaft directly by use of the clipping surfaces of the singe-pieces 5 so as to depilate hairs quickly. Two types of pieces in the conventional art, i.e. the base pieces 5' and the thin clipping pieces 6', are simplified as a type of single-pieces in the present invention, with the thin clipping pieces 6' being eliminated. Thus, the number of members is reduced, which facilitates the die sinking because only the die for forming single-pieces 5 is needed. In addition, the structure is greatly simplified and only the single-pieces 5 are required to be assembled during the assembly process. Therefore, the assembly is easy and the cost is reduced.

Figure 14:
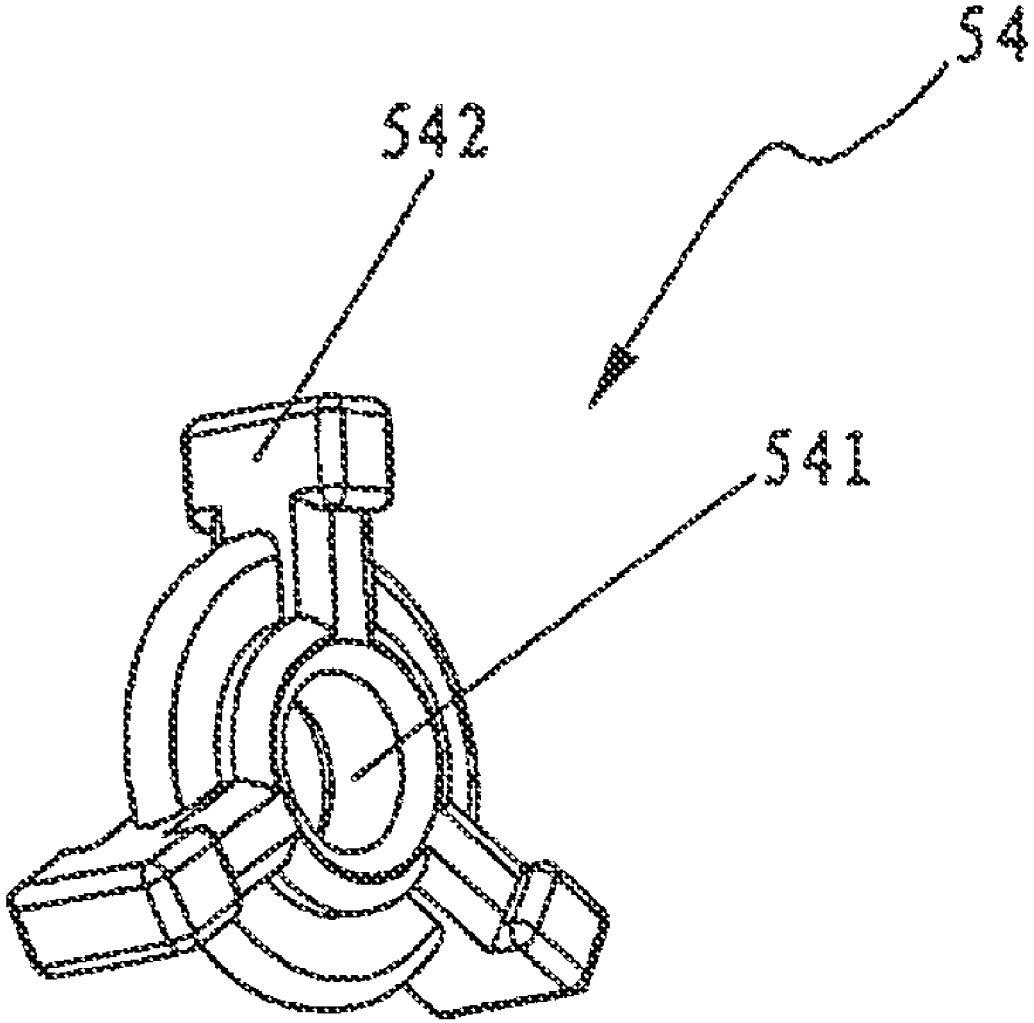
FIG. 14 is a perspective view of a fork body according to another embodiment of the present invention.
Figure 15:
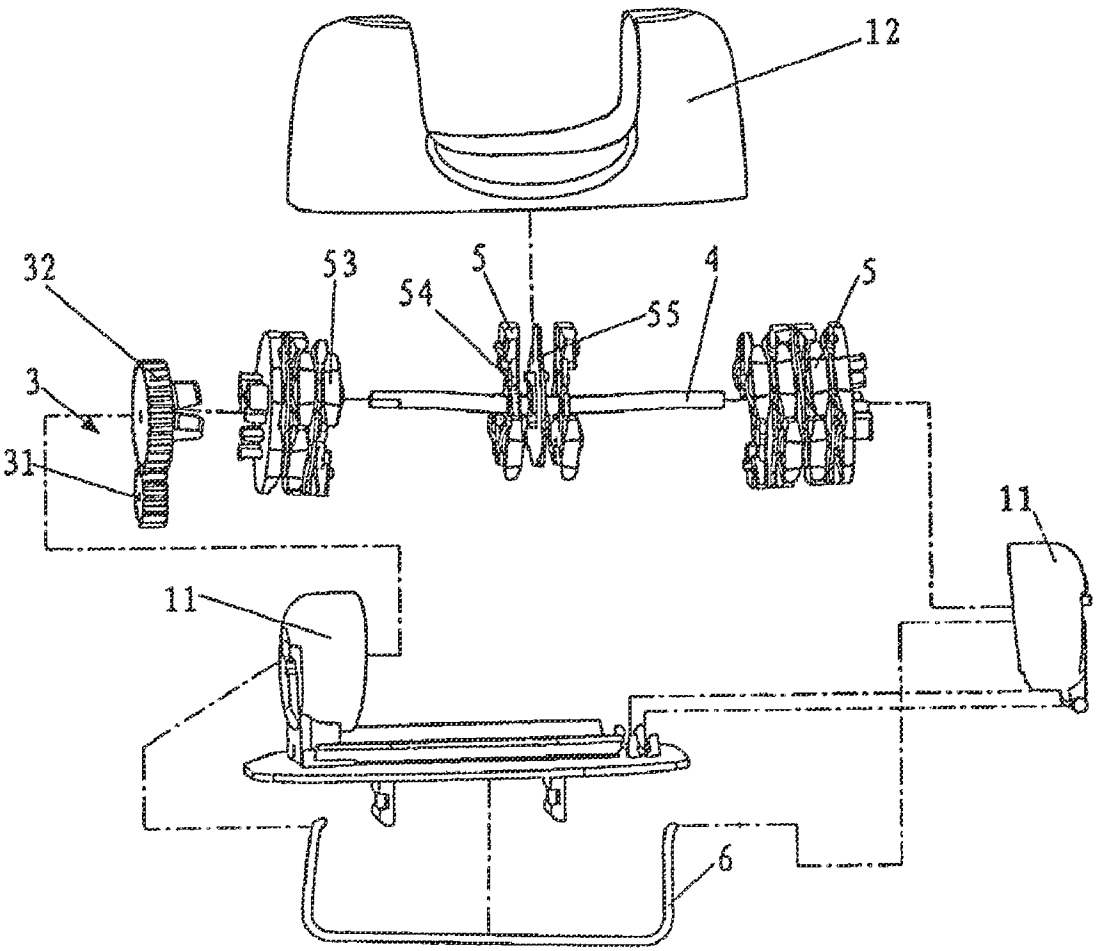
FIG. 15 is a partially exploded perspective view according to yet another embodiment of the present invention.
Figure 16:
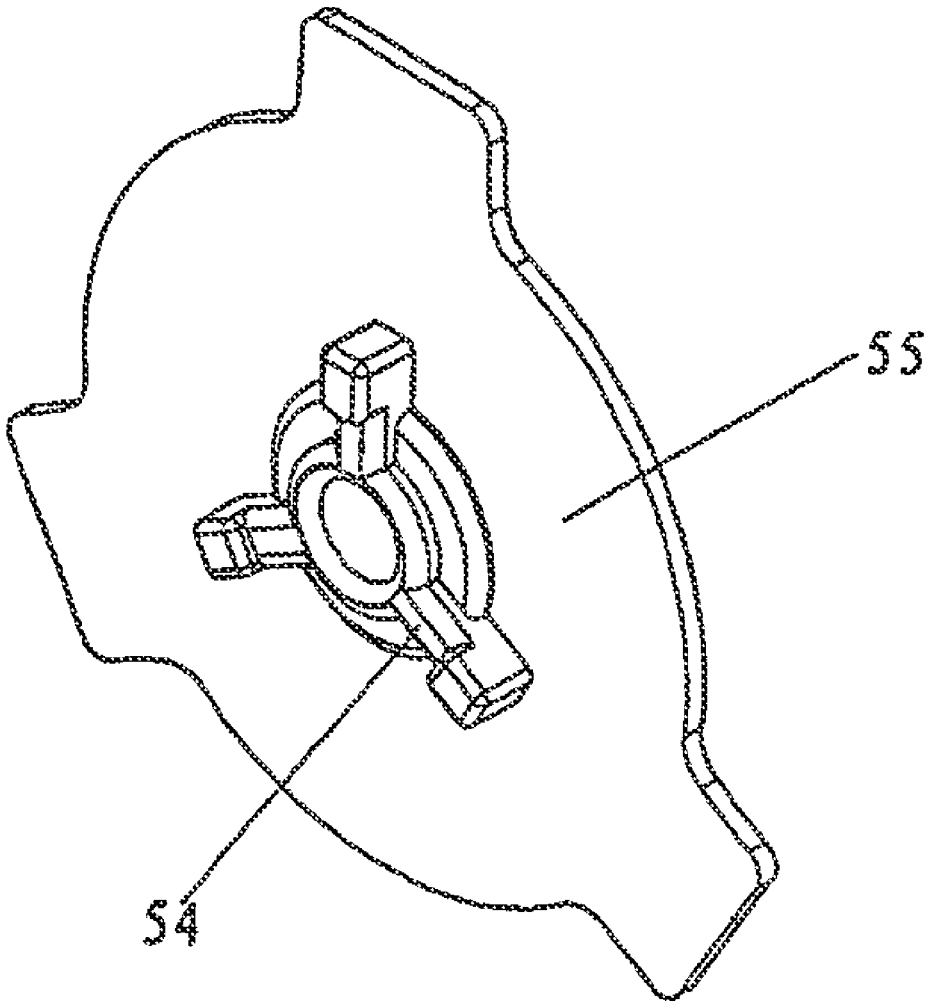
FIG. 16 is a perspective view showing the fork body and the thin piece being assembled according to yet another embodiment of the present invention.

As shown in FIGS. 15-16, a thin piece 55 is fixed on each fork body 54 shown in FIG. 14 according to yet another embodiment of the present invention. The thin pieces 55 and the fork bodies 54, together with the whole set of single-pieces 5, are fitted over the arcuate shaft 4. The thin piece 55 is provided between two opposite clipping surfaces 51 of two single-pieces 5, and two clipping gaps A are formed between both sides of each thin piece 55 and clipping surfaces 51 of two single-pieces 5, respectively. (That is, the gap A in FIG. 2 is divided into two parts.) Compared with the conventional art, two thin pieces are eliminated in this embodiment. Therefore, it is easy in die sinking, convenient in assembling, and of low cost. In addition, compared with the above two embodiments, this embodiment has twice the gaps with further introducing only one thin-piece 55. Thus, it has a better performance of depilating.

The invention claimed is:

1. An electrical depilator, comprising substantially a main body, a motor, a reduction gear set, an arcuate shaft and a depilating head, the depilating head consisting essentially of a set of single-pieces, said arcuate shaft being supported on a shaft seat of the main body, a first stage gear of said reduction gear set being meshed with a driving wheel of said motor, a last stage gear being fixed on the single-piece which is located at the endmost position, each single-piece having at least one arm, each of the arms having a clipping surface on one surface of each arm, and a supporting portion provided on each arm at a surface of the arm opposite to the clipping surface, the whole set of single-pieces being arranged in such a manner that the clipping surfaces are directly opposite to each other, a clipping gap being formed between opposite surfaces of the arms of two single-pieces, said whole set of single-pieces being coupled together by fixing members so as to rotate synchronously, and said whole set of single-pieces being fitted over the arcuate shaft all together without additional elements inserted between any of the single pieces in the set.

2. The electrical depilator according to claim 1, wherein:

the fixing members are shifting yokes which are formed on both sides of each single-piece, and one shifting yoke on a single-piece is inserted into and locked with another shifting yoke on an adjacent single-piece so that the whole set of single-pieces are coupled together and rotated synchronously.

3. The electrical depilator according to claim 1, wherein:

the fixing members are fork bodies which are provided with shaft holes at centers thereof corresponding to the position of the arcuate shaft, each single-piece is provided at both sides with fork shaped slots, and both sides of each fork body are inserted into and locked with two fork shaped slots of two adjacent single-pieces, thereby the whole set of single-pieces are coupled together and rotated synchronously.

4. The electrical depilator according to claim 1, wherein:

the fixing members are bearing housings, and the whole set of single-pieces are coupled together by the bearing housings so as to rotate synchronously.

5. The electrical depilator according to claim 1, wherein:

the fixing members are shaft pins, and the whole set of single-pieces are coupled together by the shaft pins so as to rotate synchronously.

* * * * *